US010018199B2

(12) United States Patent
Shinohara et al.

(10) Patent No.: US 10,018,199 B2
(45) Date of Patent: Jul. 10, 2018

(54) VARIABLE DISPLACEMENT PUMP

(71) Applicant: MAHLE FILTER SYSTEMS JAPAN CORPORATION, Tokyo (JP)

(72) Inventors: Toru Shinohara, Yokohama (JP); Kentaro Harada, Coburg (DE)

(73) Assignee: MAHLE FILTER SYSTEMS JAPAN CORPORATION, Tokyo (JP)

( * ) Notice: Subject to any disclaimer, the term of this patent is extended or adjusted under 35 U.S.C. 154(b) by 144 days.

(21) Appl. No.: 15/241,373

(22) Filed: Aug. 19, 2016

(65) Prior Publication Data

US 2017/0058893 A1 Mar. 2, 2017

(30) Foreign Application Priority Data

Aug. 28, 2015 (JP) ..... 2015-168519

(51) Int. Cl.

| | |
|---|---|
| ***F04C 14/22*** | (2006.01) |
| ***F04C 2/352*** | (2006.01) |
| ***F04C 14/24*** | (2006.01) |
| ***F04C 2/332*** | (2006.01) |

(52) U.S. Cl.

CPC ..... *F04C 14/226* (2013.01); *F04C 2/332* (2013.01); *F04C 2/352* (2013.01); *F04C 14/223* (2013.01); *F04C 14/24* (2013.01); *F04C 2240/30* (2013.01); *F04C 2270/18* (2013.01); *F04C 2270/185* (2013.01); *F04C 2270/70* (2013.01)

(58) Field of Classification Search

CPC ..... F04C 14/223; F04C 14/226; F04C 14/24
See application file for complete search history.

(56) References Cited

U.S. PATENT DOCUMENTS

| | | | |
|---|---|---|---|
| 8,992,184 | B2 | 3/2015 | Wagner |
| 2009/0285707 | A1 | 11/2009 | Williamson et al. |
| 2012/0301342 | A1 | 11/2012 | Ohinishi et al. |

FOREIGN PATENT DOCUMENTS

| | | | |
|---|---|---|---|
| EP | 2 440 785 | | 4/2012 |
| JP | 5620882 | B2 | 11/2014 |
| WO | WO 2008/003169 | A1 | 1/2008 |
| WO | WO 2010/142611 | A1 | 12/2010 |

OTHER PUBLICATIONS

Extended European Search Report, dated Dec. 19, 2016, 6 pages.

*Primary Examiner* — Mary A Davis
(74) *Attorney, Agent, or Firm* — Foley & Lardner LLP

(57) ABSTRACT

A variable displacement pump includes: a first pressure control chamber; a second pressure control chamber; a spring arranged to urge the cam ring in a second swing direction; a hydraulic pressure supply valve arranged to be opened by a predetermined hydraulic pressure, and thereby to introduce a control hydraulic pressure to the first control chamber; a connection passage formed in the housing or the cam ring, and arranged to connect the first pressure control chamber and the second pressure control chamber; and a relief circuit arranged to connect the second pressure control chamber and a low pressure side, to be opened or closed in accordance with a swing position of the cam ring, and to be closed when the cam ring is swung by a predetermined amount in the first direction.

4 Claims, 10 Drawing Sheets

VARIABLE DISPLACEMENT PUMP

BACKGROUND OF THE INVENTION

This invention relates to a variable displacement pump used as an oil pump arranged to supply a lubricant to an internal combustion engine, an automatic transmission, and so on.

A patent document 1 (a pamphlet of International Publication No. WO 2008/003169 A1) discloses a variable displacement pump using a vane pump. This variable displacement pump includes a cam ring which is swingably disposed within a housing; a rotor which is disposed radially inside the cam ring, and which is arranged to rotate as a unit with a drive shaft; a plurality of vanes which extend in radial directions, and whose tip end portions are slidably abutted on an inner circumference surface of the cam ring; a first spring and a second spring which are arranged to urge the cam ring in a direction where an eccentric amount of the cam ring is increased, and whose spring constants are different from each other, and a control hydraulic chamber which is defined between the housing and the cam ring. In this structure, the eccentric amount of the cam ring is controlled by urging forces of the first spring and the second spring, and a control hydraulic pressure introduced into the control hydraulic chamber.

Moreover, a patent document 2 (Japanese Patent No. 5620882) discloses a variable displacement pump includes a first spring arranged to urge a cam ring in a direction in which an eccentric amount of the cam ring is increased; a second spring which is disposed to confront the first spring, and which is arranged to urge the cam ring in a direction in which the eccentric amount of the cam ring is decreased; and a control valve which is provided in the pump housing, and which is arranged to control a control hydraulic pressure introduced into a control hydraulic chamber. In this structure, the position of the cam ring is controlled by the first spring, the second spring, and the control valve so as to stepwisely increase the hydraulic pressure.

SUMMARY OF THE INVENTION

However, in the above-described variable displacement pumps, two springs having different spring constants are used. Accordingly, the hydraulic pressure characteristics of the pump are easy to be varied due to variations of the springs.

It is an object of the present invention to provide a variable displacement pump devised to solve the above mentioned problem, to stepwisely increase a hydraulic pressure, and to suppress a variation of hydraulic pressure characteristics of the pump.

According to one aspect of the present invention, a variable displacement pump comprises: a housing; a cam ring which has a circular shape, and which is swingably received within the housing; a pump unit which is received within the cam ring, which is arranged to be drivingly rotated by a drive shaft, and whose a capacity is varied in accordance with a swing position of the cam ring; a first pressure control chamber which is defined between an inner circumference surface of the housing and an outer circumference surface of the cam ring, and which is arranged to urge the cam ring in a first swing direction; a second pressure control chamber which is defined between the inner circumference surface of the housing and the outer circumference surface of the cam ring to confront the first pressure control chamber, which is arranged to urge the cam ring in a second swing direction, and which has a pressure receiving surface which is smaller than a pressure receiving surface of the first pressure control chamber; a to spring arranged to urge the cam ring in the second swing direction; a hydraulic pressure supply valve arranged to be opened by a predetermined hydraulic pressure, and thereby to introduce a control hydraulic pressure to the first control chamber; a connection passage which is formed in one of the housing and the cam ring, and which is arranged to connect the first pressure control chamber and the second pressure control chamber; and a relief circuit which is arranged to connect the second pressure control chamber and a low pressure side, to be opened or closed in accordance with a swing position of the cam ring, and to be closed when the cam ring is swung by a predetermined amount in the first direction.

DETAILED DESCRIPTION OF THE INVENTION

Hereinafter, a first embodiment according to the present invention which is employed as an oil pump of an engine are explained in detail with reference to FIG. 1 to FIG. 7.

Figure 1:
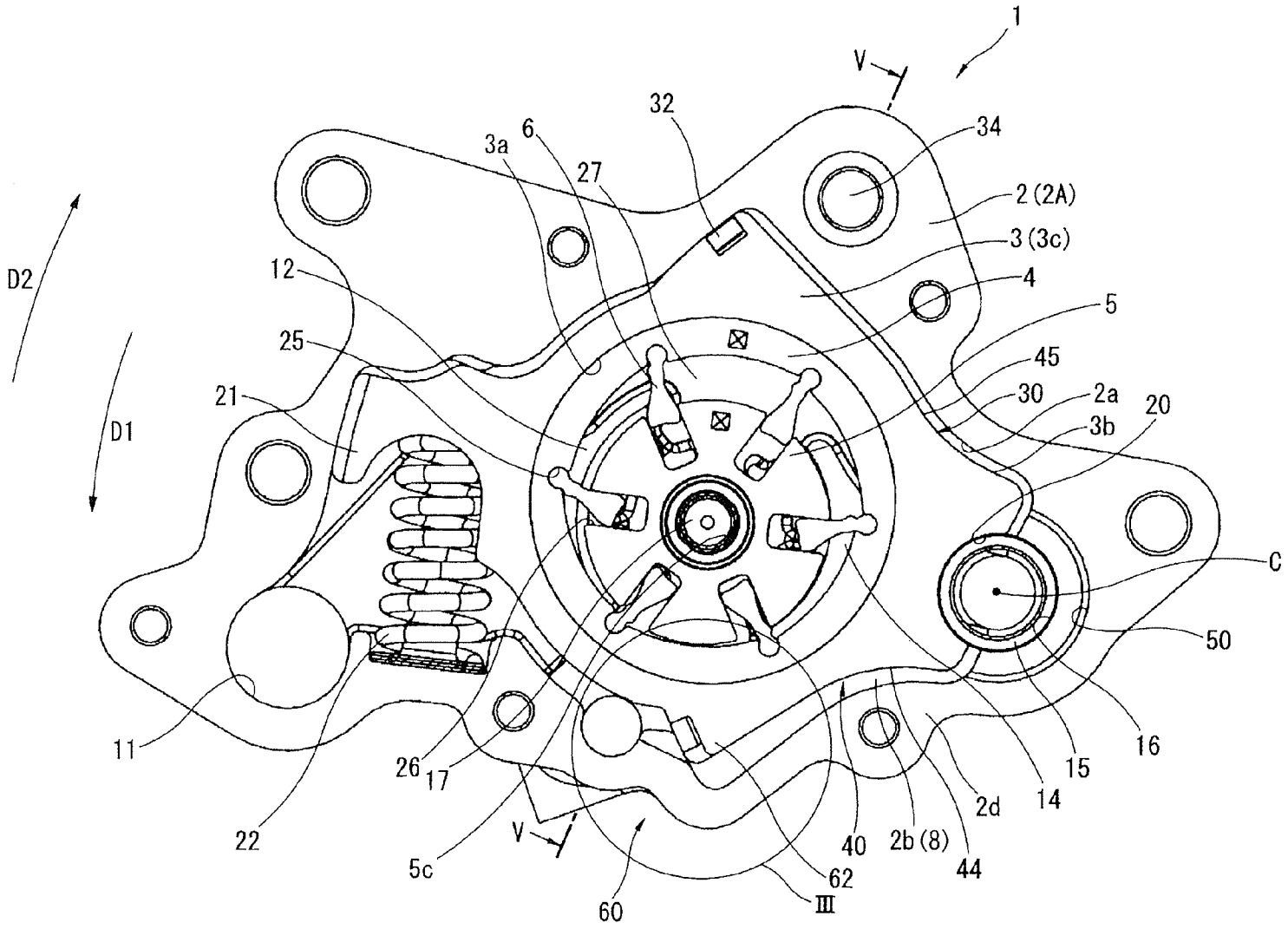
FIG. 1 is a front view showing a variable displacement pump according to a first embodiment of the present invention, in a state where a cam ring is swung at a maximum eccentric degree.
Figure 2:
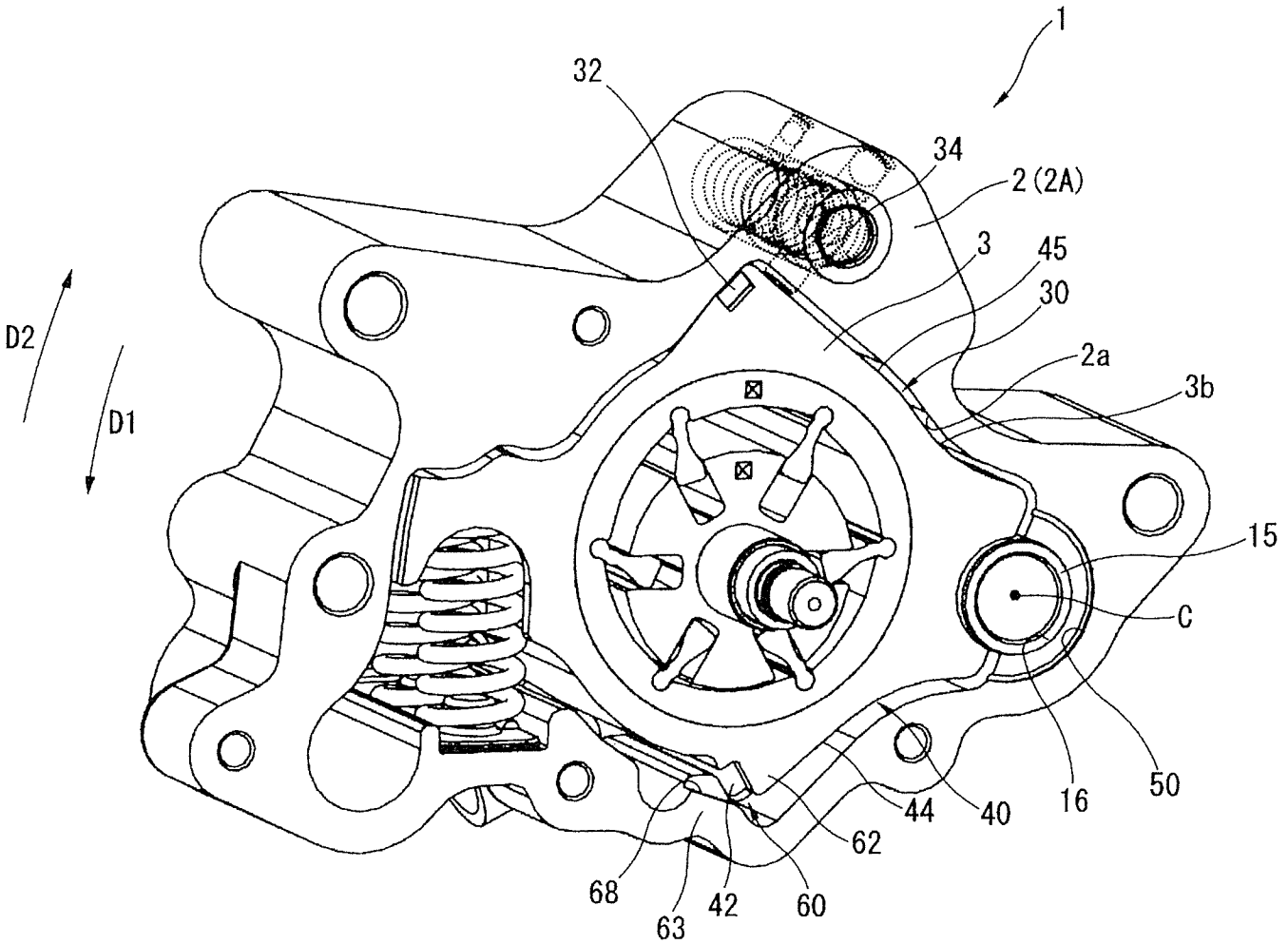
FIG. 2 is a perspective view showing the variable displacement pump according to the first embodiment.

FIG. 1 is a view showing a variable displacement pump according to the first embodiment of the present invention, in a state where a cover 2B is detached. FIG. 1 shows a state where a cam ring 3 is in a maximum eccentric state. FIG. 2 is a perspective view of the variable displacement pump of FIG. 1.

The variable displacement pump 1 includes a housing 2; the cam ring 3 which has a circular shape, and which is disposed within the housing 2; an outer rotor 4 which has a cylindrical shape, and which is mounted in an inner circumference of the cam ring 3; an inner rotor 5 which is disposed radially inside the outer rotor 4; and a plurality of pendulum-type connection plates 6 which connect the outer rotor 4 and the inner rotor 5.

The housing 2 includes a body section 2A including a cam ring receiving chamber 8 defined by a circumferential wall surface 2*a* and an end wall surface 2*b*; and a cover 2B (cf. FIG. 5) which covers the cam ring receiving chamber 8 by an end wall surface 2*c*. The body section 2A and the cover 2B are integrally tightened by bolts (not shown). A drive shaft 17 is disposed to penetrate through these end wall surfaces 2*b* and 2*c*. The end wall surface 2*b* includes a suction port 12 connected to a suction opening 11; and a discharge port 14 connected to a discharge opening (not shown). The suction port 12 and the discharge port 14 are opened to be apart from each other to form an appropriate angle (for example, 180 degrees) by the suction port 12 and the discharge port 14. Moreover, the housing 2 includes a bearing portion 16 which has a half-cylindrical shape, which is recessed on the circumferential wall surface 2*a* at a predetermined position, and which supports a pivot pin 15.

The cam ring 3 has a substantially circular shape. The cam ring 3 includes an outer rotor support surface (inner circumference surface) 3*a* which has a cylindrical shape, and which penetrates through the cam ring 3; an outer circumference surface 3*b*; and a pair of end surfaces 3*c*. The cam ring 3 is received within the cam ring receiving chamber 8 in a state where these end surfaces 3*c* of the cam ring 3 are abutted on the end wall surfaces 2*b* and 2*c*. This cam ring 3 includes a bearing portion 20 which has a half-cylindrical shape, and which is recessed on one side of the cam ring 3 (right side of FIG. 1). The cam ring 3 is swingably supported in the body section 2A by the pivot pin 15 supported by the bearing portions 16 and 20. The cam ring 3 includes a protruding arm 21 which is formed on the other side of the cam ring 3 (left side of FIG. 1) which is opposite to the bearing portion 20. A spring 22 is disposed between the arm 21 and the body section 2A. The spring 22 is a compression coil spring arranged to urge the cam ring 3 in a second swing direction D2.

An outer circumference surface of the outer rotor 4 is a simple cylindrical surface. This outer circumference surface of the outer rotor 4 is rotatably mounted in the outer rotor support surface 3*a* of the cam ring 3. Six plate holding grooves 25 are formed on an inner circumference surface of the outer rotor 4.

The inner rotor 5 includes a mounting hole 5*c* which is located at a substantially central position, and which penetrates through the inner rotor 5. The drive shaft 17 is fixed in this mounting hole 5*c*. The drive shaft 17 driven by an output of the engine is positioned at an eccentric position with respect to a center of the outer rotor 4. Accordingly, the inner rotor 5 rotates as a unit with the drive shaft 17 at an eccentric position with respect to the outer rotor 4. There is defined a crescent space formed between the outer rotor 4 and the inner rotor 5. This space is connected to the suction port 12 and the discharge port 14. Moreover, there are six slots 26 which are formed in the outer circumference surface of the inner rotor 5, and which extend in radial directions.

Each of the connection plates 6 includes an outer circumference end which is swingably mounted in one of the plate holding grooves 25 of the outer rotor 4; and an inner circumference end which is swingably inserted in one of the slots 26 of the inner rotor 5, so as to transmit a rotational force from the inner rotor 5 to the outer rotor 4. These six connection plates 6 separate the space between the outer rotor 4 and the inner rotor 5 into six chambers 27.

The housing 2, the cam ring 3, the outer rotor 4, and the inner rotor 5 are made from metal, or hard synthetic resin.

In the thus-constructed variable displacement pump 1, the inner rotor 5 is rotated through the drive shaft 17 in a clockwise direction of FIG. 1. This rotational force is transmitted through the connection plates 6 to the outer rotor 4, so that the outer rotor 4 is rotated in the same direction. A distance between the inner circumference surface of the outer rotor 4 and the outer circumference surface of the inner rotor 5 is varied in accordance with the rotation positions of the outer rotor 4 and the inner rotor 5 which are eccentric with respect to each other. Accordingly, volumes of the chambers 27 are varied in accordance with the variation of the distance between the inner circumference surface of the outer rotor 4 and the outer circumference surface of the inner rotor 5. The volume of each chamber 27 becomes minimum when the each chamber 27 is located at a lower side of FIG. 1. The volume of the each chamber 27 is gradually increased in accordance with the rotation in the clockwise direction from this lower side position. The volume of the each chamber 27 becomes maximum when the each chamber 27 is located at an upper side of FIG. 1. Then, the volume of the each chamber 27 is decreased again from this upper side position. It is possible to obtain a pump function to pump (feed) the oil from the suction port 12 to the discharge port 14, by these volume variations of the chambers 27.

Next, a control mechanism of the cam ring 3 which is a main part in the present invention is explained with reference to FIG. 1 to FIG. 7.

A first pressure control chamber 30 is defined between the circumference wall surface 2*a* of the housing 2 and the outer circumference surface 3*b* of the cam ring 3. This first pressure control chamber 30 is arranged to urge the cam ring 3 in a first swing direction D1 against the spring 22. The first pressure control chamber 30 includes a first end portion partitioned by the pivot pin 15; and a second end portion which is constantly sealed by a seal member 32 disposed on the cam ring 3.

Figure 5B:
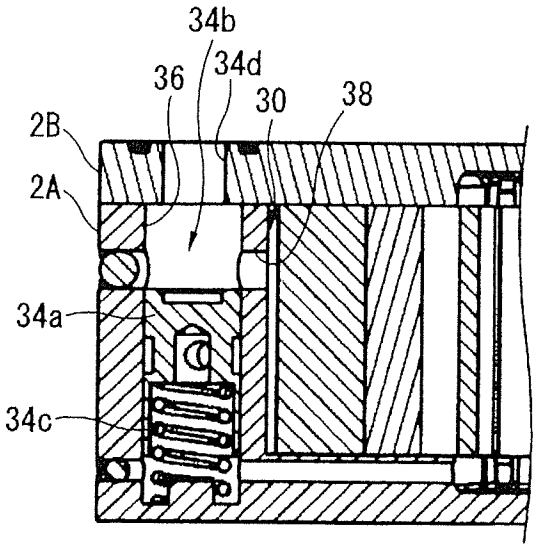
FIGS. 5A and 5B are sectional views which show a spool valve, and which are taken along a section line V-V of FIG. 1.
Figure 5A:
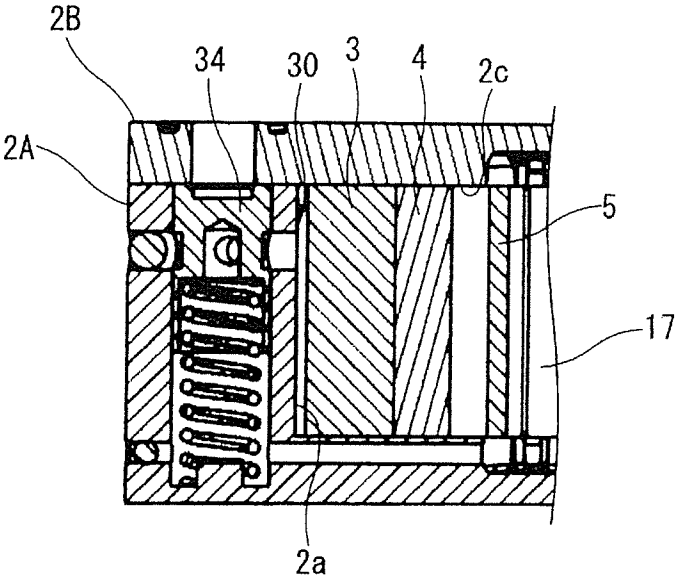

A spool valve 34 is provided to the body section 2A adjacent to this first pressure control chamber 30. This spool valve 34 serves as a hydraulic pressure supply valve arranged to introduce a control hydraulic pressure to the first pressure control chamber 30. The spool valve 34 is connected to a hydraulic pressure supply passage (not shown) connected to a main gallery of the engine. The spool valve 34 is arranged to be opened when the hydraulic pressure of the main gallery which is the control hydraulic pressure exceeds a predetermined value (for example, 0.15 MPa). As shown in FIG. 5, the spool valve 34 includes a valve element 34*a* which is slidably received within a receiving chamber 36 extending in an axial direction of the housing 2; a hydraulic chamber 34*b* which is provided on one end side; and a spring 34*c* which is arranged to urge the valve element 34*a* toward the hydraulic chamber 34*b*. Moreover, the housing 2 includes an opening portion 38 which is opened on the circumferential wall surface 2*a* of the housing 2, and which is arranged to be closed and opened by the valve element 34*a*. When the spool valve 34 is opened, the control hydraulic pressure is introduced from a hydraulic pressure inlet 34*d* through the hydraulic chamber 34*b* and the opening portion 38 into the first pressure control chamber 30.

A second pressure control chamber 40 is defined between the circumference wall surface 2*a* of the housing 2 and the outer circumference surface 3*b* of the cam ring 3 so as to confront the first pressure control chamber 30. The second pressure control chamber 40 is arranged to urge the cam ring 3 in the second swing direction D2. This second pressure control chamber 40 extends between the pivot pin 15 and a seal member 42 (FIG. 3) disposed on the cam ring 3. In this case, an area of a second pressure receiving surface 44 of the cam ring 3 with respect to the second pressure control chamber 44 is set to be smaller than an area of a first pressure receiving surface 45 of the cam ring 3 with respect to the first pressure control chamber 30.

An eccentric amount of the cam ring 3 is controlled by a relationship among the first pressure control chamber 30, the second pressure control chamber 40, and the spring 22.

The housing 2 includes a connection passage 50 which is formed in the housing 2 between the first pressure control chamber 30 and the second pressure control chamber 40 so as to connect the first pressure control chamber 30 and the second pressure control chamber 40. The connection passage 50 has a semi-circular shape. The connection passage 50 extends along the bearing section 16 between the first pressure control chamber 30 and the second pressure control chamber 40. The connection passage 50 is a passage which has an extremely small passage cross section, which serves as an orifice, and which is arranged to introduce an extremely small amount of the hydraulic fluid within the first pressure control chamber 30, into the second pressure control chamber 40.

Furthermore, a relief circuit (relief section) 60 is provided between the second pressure control chamber 40 and the suction opening 11's side, that is, the low pressure side, as shown in FIG. 1 and FIG. 2. The relief circuit 60 is arranged to relieve the control hydraulic pressure within the second pressure control chamber 40 to the low pressure side. The relief circuit 60 includes a raised portion 62 protruding from the cam ring 3, and a raised portion 63 protruding from the housing 2, so as to be closed and opened in accordance with the swing position of the cam ring 3. The raised portion 62 and the raised portion 63 are disposed so as to be superimposed on each other along a tangent direction with respect to a swing center C of the cam ring 3. The raised portion 62 includes a seal surface 64 which extends in the tangent direction with respect to the swing center C of the cam ring 3. The seal member 42 made from synthetic resin is received within a seal groove 64*a* which is formed by cutting out this seal surface 64. The raised portion 63 includes a seal surface 65 confronting the seal surface 64.

Figure 3:
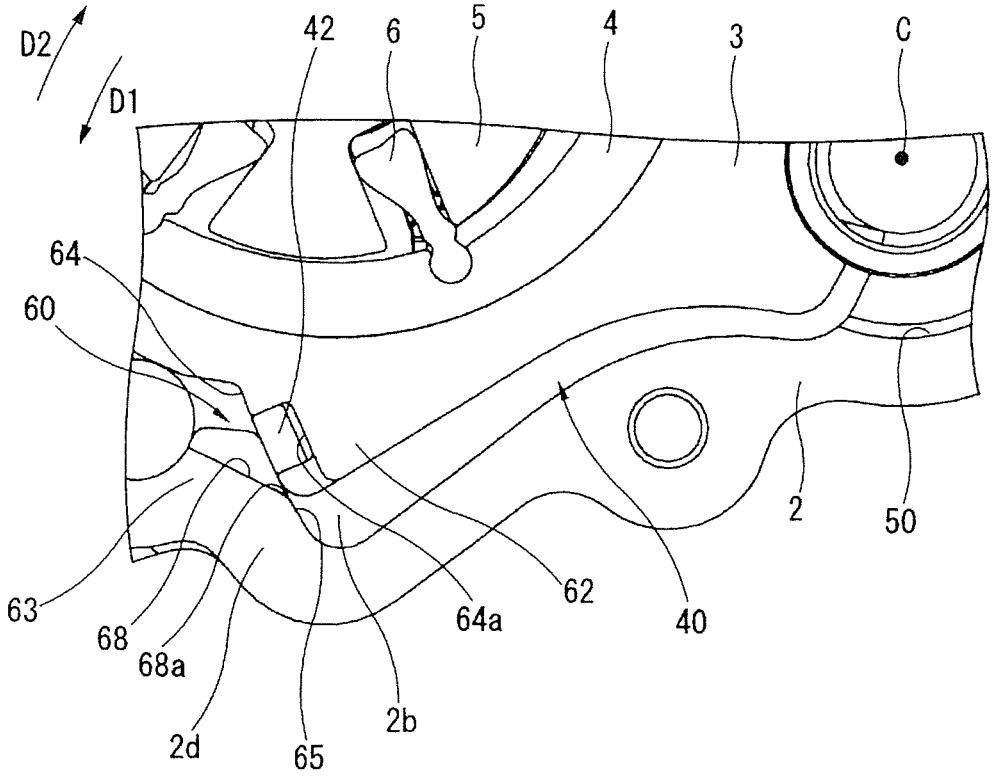
FIG. 3 is an enlarged view showing one example of a relief circuit, and showing a III portion of FIG. 1.
Figure 4:
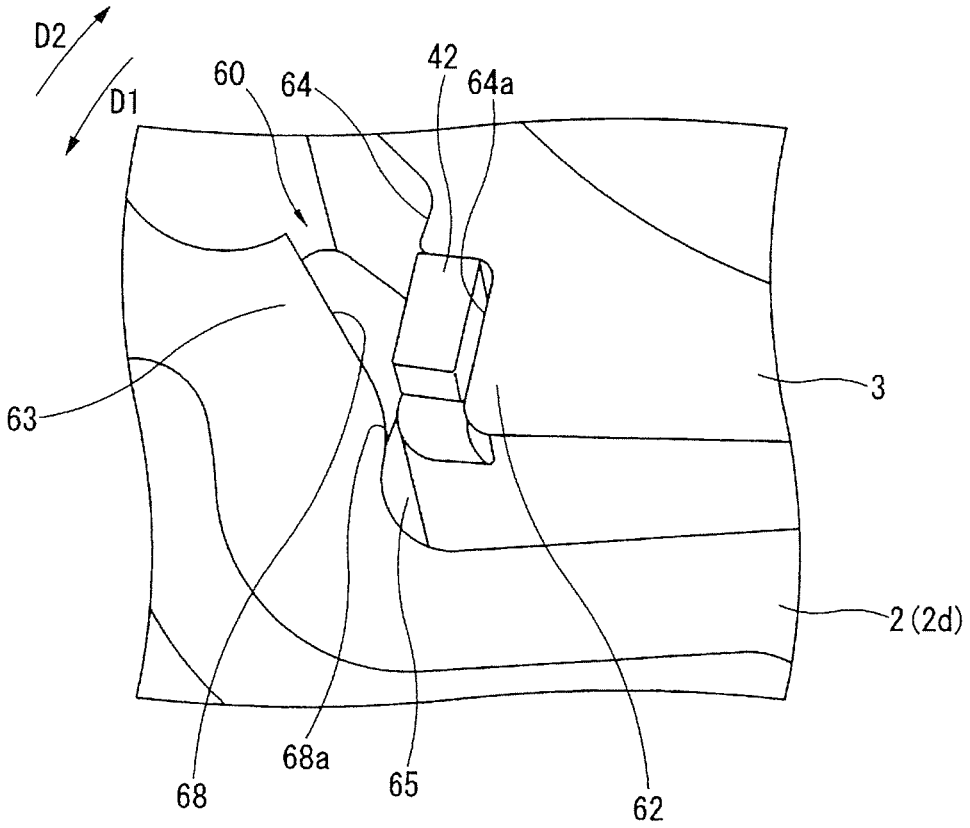
FIG. 4 is an enlarged perspective view showing the III portion of FIG. 1.

As shown in FIG. 3 and FIG. 4, the seal surface 65 includes a cutout passage 68 which is formed by cutting out an apex portion of the raised portion 63 of the housing 2. The cutout passage 68 is recessed from the end surface 2*d* of the body section 2A toward the end wall surface 2*b* of the body section 2A. The opening end of the cutout passage 68 on the second pressure control chamber 40's side is arranged to be opened and closed by the seal member 42. In particular, the cutaway passage 68 is opened at an initial position at which the cam ring 3 is swung in the second swing direction D2 at the maximum degree. When the cam ring 3 is swung in the first swing direction D1 by a predetermined amount, the cutaway passage 68 is closed by the seal member 42.

Next, hydraulic pressure characteristics of the variable displacement pump according to this embodiment are explained.

In the initial state of the thus-constructed variable displacement pump 1 which is shown in FIG. 1, the cam ring 3 is urged in the second swing direction D2 by the spring 22, so that the eccentric amount of the cam ring 3 with respect to the inner rotor 5 becomes maximum. Accordingly, the pump capacity becomes maximum.

In a first region from zero to a rotation speed N1, the hydraulic pressure does not reach a setting pressure of the spool valve 34 (for example, 0.15 MPa). Accordingly, the spool valve 34 is not opened. Consequently, the control hydraulic pressure is not introduced into the first pressure control chamber 30. Therefore, the eccentric amount of the cam ring 3 is not varied from the initial state which is the maximum eccentric amount. The hydraulic pressure of the main gallery of the engine is increased in accordance with the increase of the engine speed.

Figure 6:
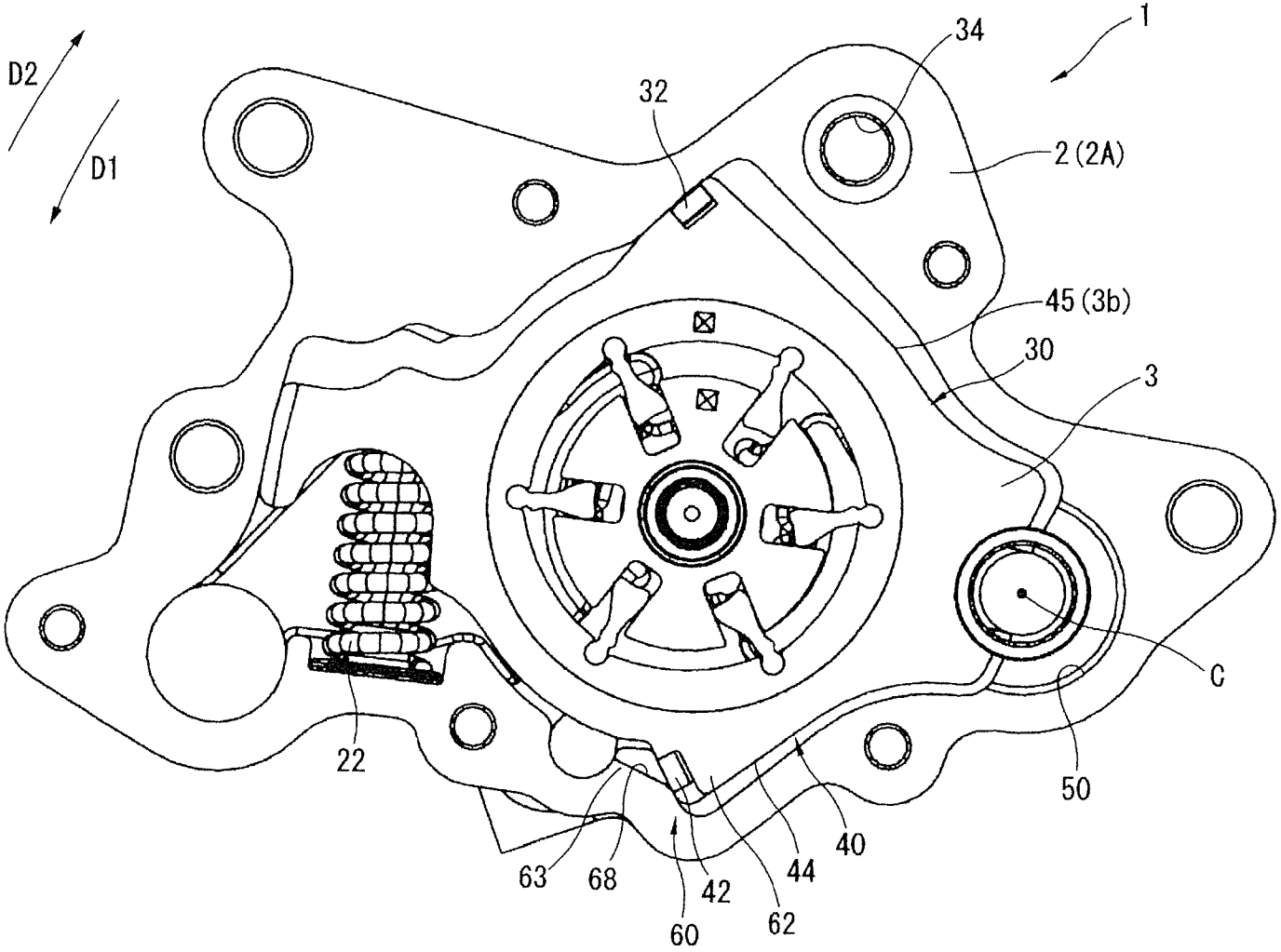
FIG. 6 is a front view showing the variable displacement pump in a state where the eccentric amount of the cam ring is decreased.

When the control hydraulic pressure is increased to the setting pressure at the rotation speed N1, the valve element 34*a* of the spool valve 34 is pressed toward the spring 34*c*, so that the main gallery of the engine and the first pressure control chamber 30 are connected with each other. The control hydraulic pressure is introduced through the opening portion 38 to the first pressure control chamber 30 (FIG. 5(B)). A portion of the hydraulic fluid which is the control hydraulic pressure is introduced through the connection passage 50 to the second pressure control chamber 40. However, the relief circuit 60 (the cutout passage 68) is opened at the swing position of the cam ring 3 within this region. The second pressure control chamber 40 is not closed (sealed). Accordingly, the control hydraulic pressure is not acted on the second pressure receiving surface 44. Moreover, the connection passage 50 has an appropriate passage resistance. Consequently, the hydraulic pressure within the first pressure control chamber 30 is held to the control hydraulic pressure. Therefore, the control hydraulic pressure introduced into the first pressure control chamber 30 is acted on the first pressure receiving surface 45. With this, the cam ring 3 is swung against the urging force of the spring 22, that is, in the first swing direction D1 in which the eccentric amount is decreased (FIG. 6). That is, the cam ring 3 is swung to a position at which the urging force of the spring 22 and the control hydraulic pressure are balanced with each other. Consequently, the capacity of the variable displacement pump 1 is decreased. Therefore, in this second region, the hydraulic pressure is maintained to a substantially constant value with respect to the increase of the rotation speed.

In a third region between the rotation speeds N2 and N3, the engine speed reaches the target rotation speed N2. When the cam ring 3 is swung in the swing direction D1 by the predetermined amount, one end 68*a* of the cutout passage 68 is closed by the seal surface 64, so that the second pressure control chamber 40 is closed (sealed). Accordingly, the control hydraulic pressure which is identical to that of the first pressure control chamber 30 is acted on the second pressure receiving surface 44 of the second pressure control chamber 40. With this, the urging force of the first pressure control chamber 30 is canceled. The swing movement of the cam ring 3 in the first swing direction D1 is suppressed. Consequently, in this (third) region, the hydraulic pressure is increased again in accordance with the increase of the engine speed. Besides, there is a difference between the pressure receiving areas of the first pressure receiving surface 45 and the second pressure receiving surface 46. Accordingly, the cam ring 3 is gradually swung in the first swing direction.

Figure 7:
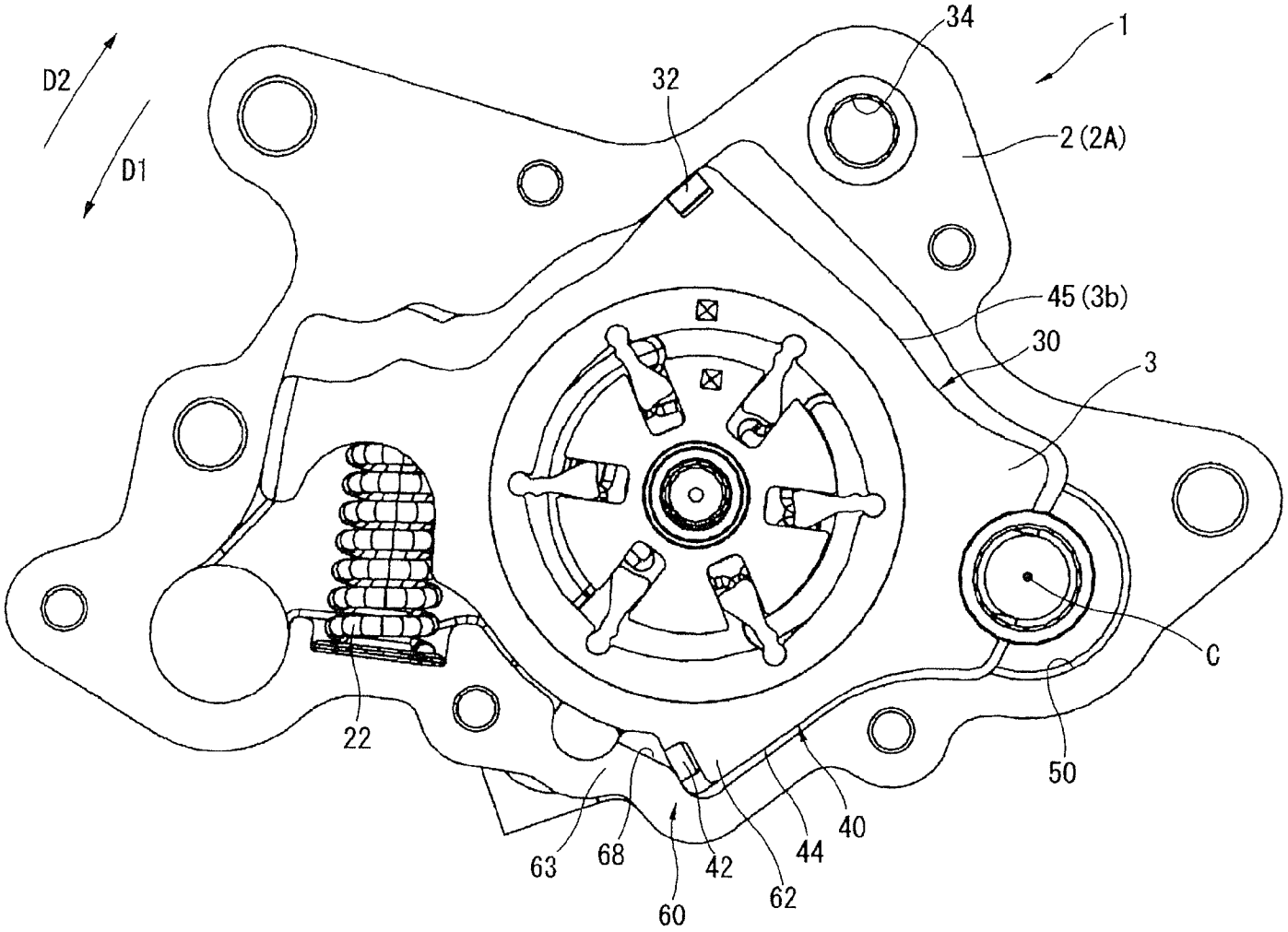
FIG. 7 is a front view showing the variable displacement pump in a state where the eccentric amount of the cam ring is zero.
Figure 8:
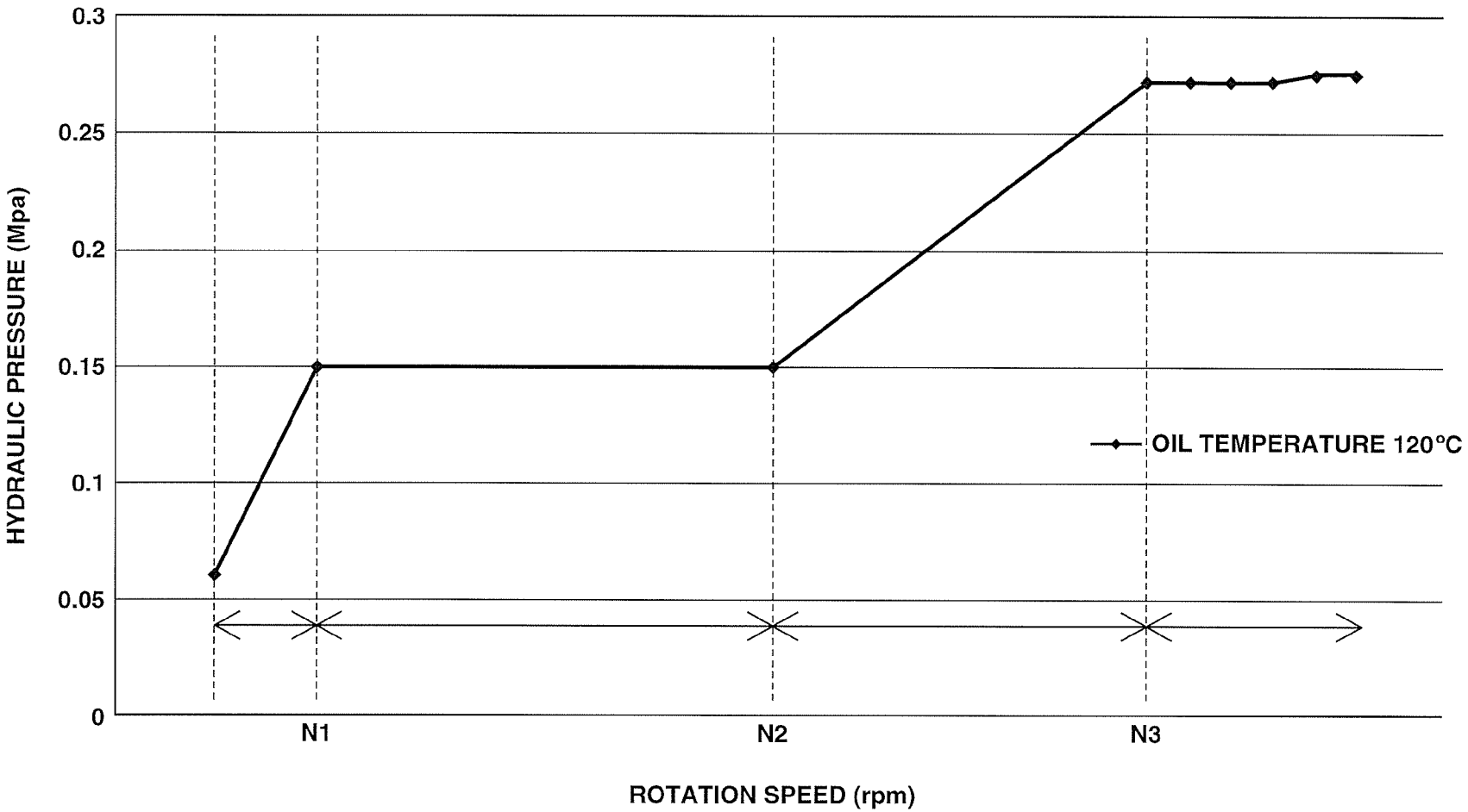
FIG. 8 is a graph showing a relationship between a rotational speed of the pump and a hydraulic pressure.

When the rotation speed reaches the rotation speed N3, the eccentric amount of the cam ring 3 becomes substantially zero (FIG. 7). In the fourth region in which the rotation speed is equal to or greater than the rotation speed N3, the hydraulic pressure becomes substantially constant. Besides, when the hydraulic pressure becomes equal to or greater than a predetermined upper limit pressure (for example, substantially 0.3 MPa), a relief valve (not shown) is opened, so that the hydraulic pressure is discharged from the discharge port 14 through this relief valve to the suction side.

In the example shown in the drawings, the oil temperature is 120 degrees. The rotation speeds N1, N2, and N3 are set to, for example, 1000 rpm, 4000 rpm, and 6000 rpm. It is possible to arbitrarily set these target rotation speeds N1, N2, and N3.

Figure 9:
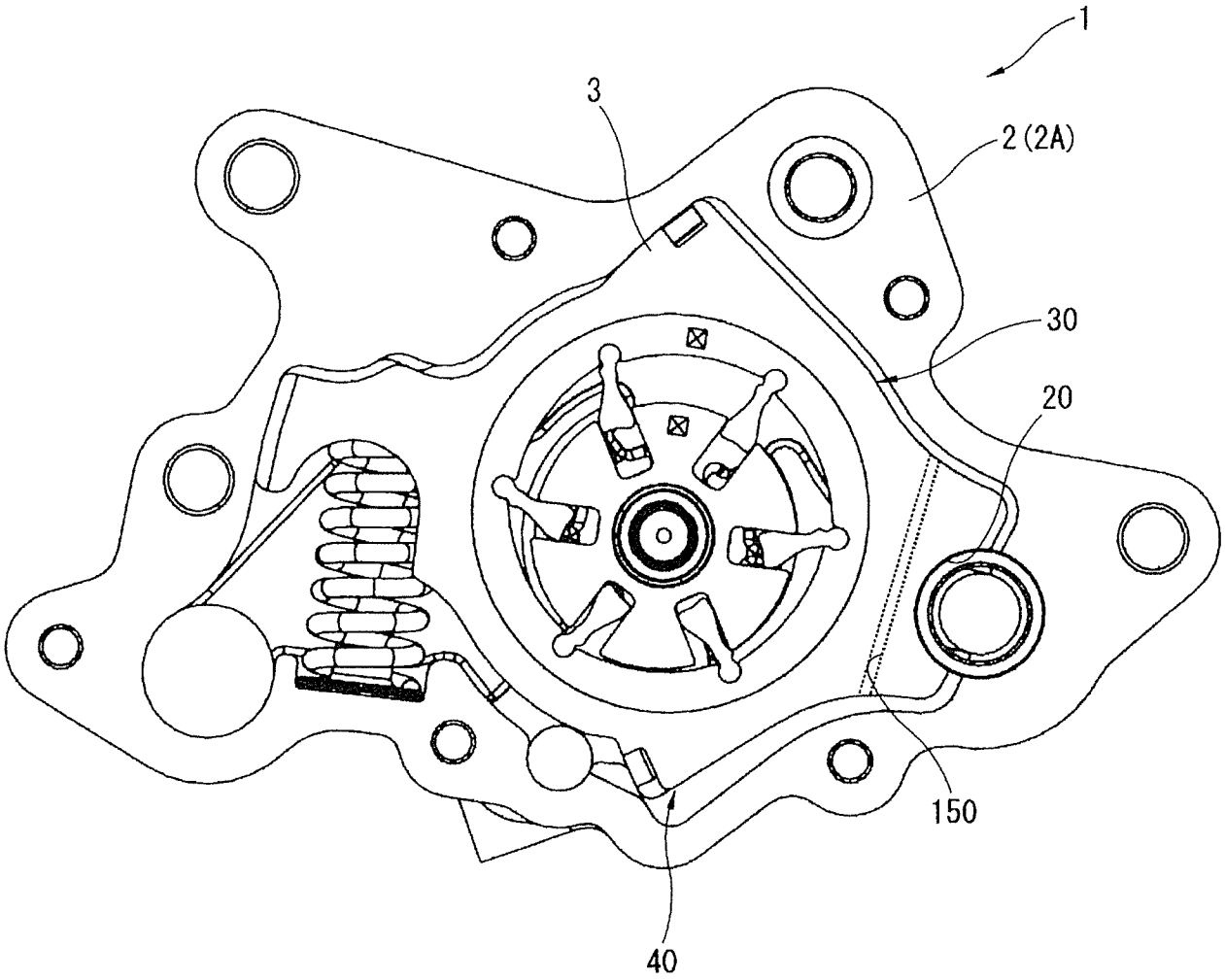
FIG. 9 is a front view showing a variable displacement pump according to a second embodiment of the present invention.

Next, a variable displacement pump 1 according to a second embodiment of the present invention is illustrated with reference to FIG. 9.

In this embodiment, a connection passage 150 is provided in the cam ring 3. The connection passage 150 is formed near the bearing section 20. The connection passage 150 penetrates through the cam ring 3 so as to linearly extend between the first pressure control chamber 30 and the second pressure control chamber 40. The connection passage 150 is a passage having an extremely small passage cross section which is arranged to introduce an extremely small amount of the hydraulic fluid within the first pressure control chamber 30, into the second pressure control chamber 40.

Next, a variable displacement pump 1 according to a third embodiment of the present invention is illustrated with reference to FIG. 10.

In this embodiment, a relief circuit includes a through hole 160 which is formed to penetrate through the end wall surface 2*b*, and which has a circular section. The through hole 160 extends in the axial direction of the body section 2A so as to connect the second pressure control chamber 40 and the low pressure side (for example, the oil pan).

Figure 10:
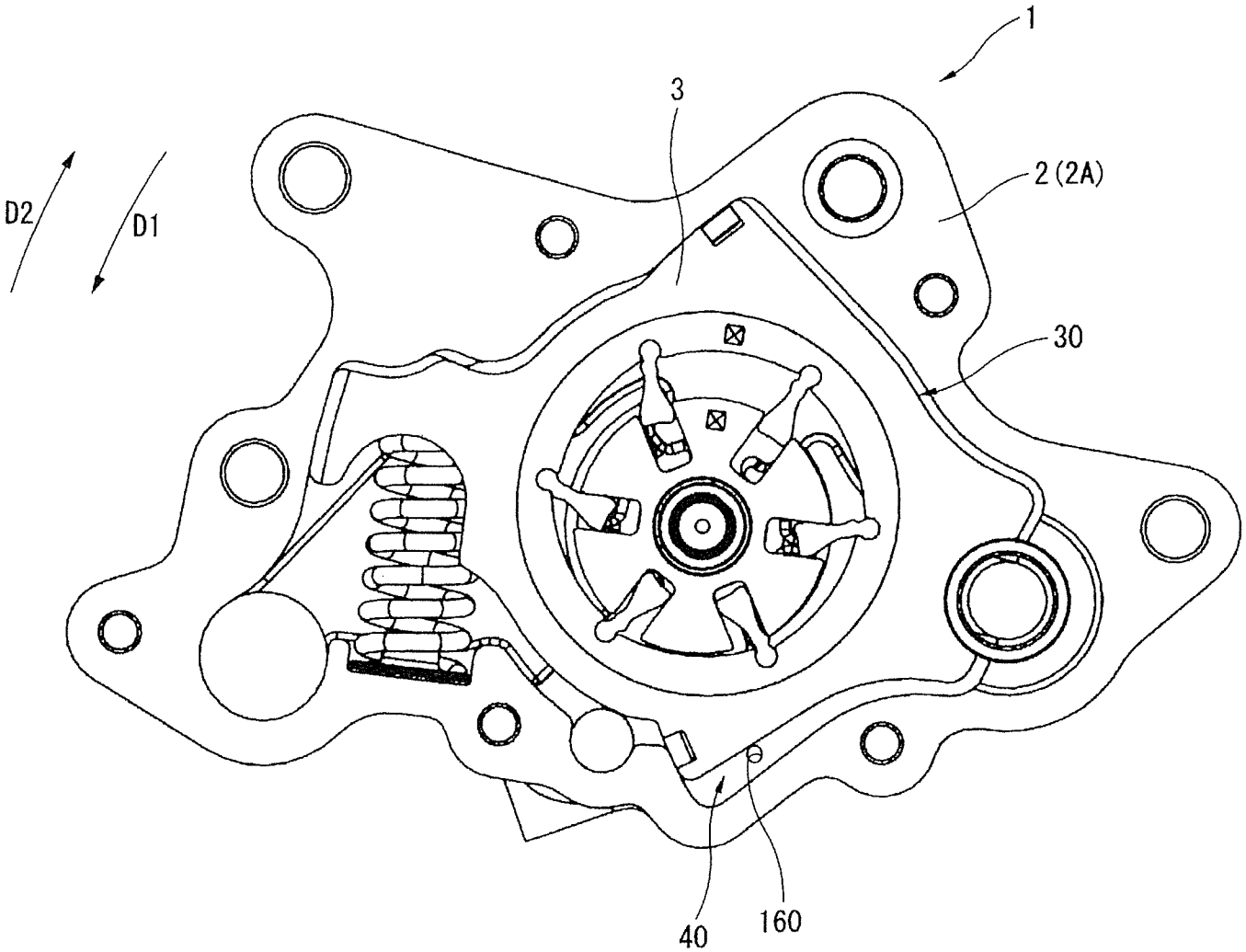
FIG. 10 is a front view showing a variable displacement pump according to a third embodiment of the present invention.

In the initial state of the variable displacement pump 1 shown in FIG. 10, that is, in a case where the cam ring 3 is swung at the maximum degree in the second swing direction D2, the through hole 160 discharges the control hydraulic pressure within the second pressure control chamber 40 to the low pressure side. On the other hand, when the cam ring 3 is swung by a predetermined amount in the first swing direction D1, an opening end of the through hole 160 is covered with one end surface (not shown) of the cam ring 3. With this, the second pressure control chamber 40 is closed (sealed).

Hereinabove, the embodiments according to the present invention are illustrated. However, the present invention is not limited to the above-described embodiments. It is possible to employ various variations.

In the above-described embodiments, the six connection plates 6 connect the outer rotor 4 and the inner rotor 5. However, it is possible to employ numbers (for example, seven or eight connection plates 6) which is other than six.

In this embodiment, the variable displacement pump 1 is the variable displacement pump of the pendulum type (variable displacement pendulum slider pump). However, the present invention is applicable to a variable displacement pump of a vane type.

In the above-described embodiments, the suction port 12 and the discharge port 14 are formed on the end wall surface 2*b* of the housing body section 2A. However, the present invention is not limited to these structure. The suction ports 12 and the discharge ports 14 may be formed on both the end wall surface 2*b* and the end wall surface 2*c* of the cover 2B. Moreover, the suction port 12 and the discharge port 14 may be formed only on the cover 2B. Furthermore, one of the suction port 12 and the discharge port 14 may be formed on the end wall surface 2*b*, and the other of the suction port 12 and the discharge port 14 may be formed on the cover 2B.

In the present invention, a variable displacement pump includes: a housing; a cam ring which has a circular shape, and which is swingably received within the housing; a pump unit which is received within the cam ring, which is arranged to be drivingly rotated by a drive shaft, and whose a capacity is varied in accordance with a swing position of the cam ring; a first pressure control chamber which is defined between an inner circumference surface of the housing and an outer circumference surface of the cam ring, and which is arranged to urge the cam ring in a first swing direction; a second pressure control chamber which is defined between the inner circumference surface of the housing and the outer circumference surface of the cam ring to confront the first pressure control chamber, which is arranged to urge the cam ring in a second swing direction, and which has a pressure receiving surface which is smaller than a pressure receiving surface of the first pressure control chamber; a spring arranged to urge the cam ring in the second swing direction; a hydraulic pressure supply valve arranged to be opened by a predetermined hydraulic pressure, and thereby to introduce a control hydraulic pressure to the first control chamber; a connection passage which is formed in one of the housing and the cam ring, and which is arranged to connect the first pressure control chamber and the second pressure control chamber; and a relief circuit which is arranged to connect the second pressure control chamber and a low pressure side, to be opened or closed in accordance with a swing position of the cam ring, and to be closed when the cam ring is swung by a predetermined amount in the first direction.

In this structure, the hydraulic pressure supply valve is not opened until the hydraulic pressure reaches a predetermined hydraulic pressure. The control hydraulic pressure is not introduced into the first pressure control chamber. Accordingly, the cam ring is urged in the second swing direction by the spring. The cam ring is maintained at the initial position at which the capacity becomes maximum.

When the control hydraulic pressure reaches the predetermined hydraulic pressure, the hydraulic pressure supply valve is opened to introduce the control hydraulic pressure into the first pressure control chamber. Accordingly, the cam ring is swung in the first swing direction to a position at which the control hydraulic pressure within the first pressure control chamber is balanced with the urging force of the spring. Consequently, the capacity of the pump is decreased in accordance with the increase of the hydraulic pressure. A part of the oil is introduced from the first pressure control chamber through the connection passage into the second pressure control chamber. However, the relief circuit is opened until the cam ring is swung by a predetermined amount in the first swing direction, so that the second pressure control chamber is not closed. Accordingly, the control hydraulic pressure is not acted on the pressure receiving surface with respect to the second pressure control chamber.

When the cam ring is swung by the predetermined amount in the first swing direction, the relief circuit is closed, so that the second pressure control chamber is closed. The control hydraulic pressure is acted on the pressure receiving surface of the second pressure control chamber. The urging force by the first pressure control chamber is canceled. The swing movement of the cam ring in the first swing direction is suppressed. Accordingly, the decrease of the capacity with respect to the increase of the hydraulic pressure becomes slow.

Moreover, in the present invention, the pump unit includes an outer rotor which has a cylindrical shape, and which is rotatably mounted in an inner circumference surface of the cam ring, an inner rotor which is disposed radially inside the outer rotor, and which is arranged to rotate as a unit with the drive shaft at a position which is eccentric with respect to the outer rotor, and a plurality of connection plates which connect the inner rotor and the outer rotor, which is arranged to transmit a rotation force from the inner rotor to the outer rotor, and which separate a space defined between the outer rotor and the inner rotor into a plurality of chambers.

Furthermore, the pump unit may be a pump unit of a vane pump type described in the patent documents 1 and 2.

Moreover, in the present invention, the relief circuit includes a raised portion of the cam ring and a raised portion of the housing; the raised portion of the cam ring and the raised portion of the housing are superimposed on each other in a tangent direction with respect to a swing center of the cam ring. Alternately, the relief circuit includes a through hole which penetrates through the housing in an axial direction of the housing; and the through hole of the relief circuit includes an opening end arranged to be covered with the cam ring.

In the above-described variable displacement pumps according to the embodiments of the present invention, it is possible to suppress the swing movement of the cam ring without using two springs having different spring constants, and to stepwisely increase the hydraulic pressure.

The entire contents of Japanese Patent Application No. 2015-168519 filed Aug. 28, 2015 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement pump comprising:

a housing;

a cam ring which has a circular shape, and which is swingably received within the housing;

a pump unit which is received within the cam ring, which is arranged to be drivingly rotated by a drive shaft, and whose a capacity is varied in accordance with a swing position of the cam ring;

a first pressure control chamber which is defined between an inner circumference surface of the housing and an outer circumference surface of the cam ring, and which is arranged to urge the cam ring in a first swing direction;

a second pressure control chamber which is defined between the inner circumference surface of the housing and the outer circumference surface of the cam ring to confront the first pressure control chamber, which is arranged to urge the cam ring in a second swing direction, and which has a pressure receiving surface which is smaller than a pressure receiving surface of the first pressure control chamber;

a spring arranged to urge the cam ring in the second swing direction;

a hydraulic pressure supply valve arranged to be opened by a predetermined hydraulic pressure, and thereby to introduce a control hydraulic pressure to the first control chamber;

a connection passage which is formed in one of the housing and the cam ring, and which is arranged to connect the first pressure control chamber and the second pressure control chamber; and a relief circuit which is arranged to connect the second pressure control chamber and a low pressure side, to be opened or closed in accordance with a swing position of the cam ring, and to be closed when the cam ring is swung by a predetermined amount in the first direction.

2. The variable displacement pump as claimed in claim 1, wherein the pump unit includes an outer rotor which has a cylindrical shape, and which is rotatably mounted in an inner circumference surface of the cam ring, an inner rotor which is disposed radially inside the outer rotor, and which is arranged to rotate as a unit with the drive shaft at a position which is eccentric with respect to the outer rotor, and a plurality of connection plates which connect the inner rotor and the outer rotor, which is arranged to transmit a rotation force from the inner rotor to the outer rotor, and which separate a space defined between the outer rotor and the inner rotor into a plurality of chambers.

3. The variable displacement pump as claimed in claim 1, wherein the relief circuit includes a raised portion of the cam ring and a raised portion of the housing; the raised portion of the cam ring and the raised portion of the housing are superimposed on each other in a tangent direction with respect to a swing center of the cam ring.

4. The variable displacement pump as claimed in claim 1, wherein the relief circuit includes a through hole which penetrates through the housing in an axial direction of the housing; and the through hole of the relief circuit includes an opening end arranged to be covered with the cam ring.

* * * * *